United States Patent [19]

McNamara, Jr.

[11] 4,042,817

[45] Aug. 16, 1977

[54] QUASI-INDIRECT MONOSYMMETRICAL LIGHTING SYSTEM

[76] Inventor: Albert C. McNamara, Jr., 210 E. Mimosa Circle, San Marcos, Tex. 78666

[21] Appl. No.: 589,947

[22] Filed: June 24, 1975

Related U.S. Application Data

[63] Continuation-in-part of Ser. No. 376,320, July 5, 1973, abandoned.

[51] Int. Cl.[2] ..... F21S 3/02

[52] U.S. Cl. ..... 240/9 R; 240/46.31; 240/46.33; 240/73 BC; 240/78 H; 240/78 HA

[58] Field of Search ..... 240/9 R, 46.31, 46.33, 240/46.35, 46.37, 46.39, 46.41, 46.45, 73 BC, 78 H, 78 HA

[56] References Cited

U.S. PATENT DOCUMENTS

| | | | |
|---|---|---|---|
| 1,900,436 | 3/1933 | Dourgnon | 240/9 R |
| 2,428,827 | 10/1947 | Beck | 240/9 R |
| 3,560,729 | 2/1971 | Liberman | 240/9 R |
| 3,600,569 | 8/1971 | Matteson | 240/78 H |

OTHER PUBLICATIONS

"Studies of Illumination & Brightness," *Illumination Engineering,* Jan. 1947, pp. 96–97.

*Primary Examiner*—Russell E. Adams
*Attorney, Agent, or Firm*—Frank S. Vaden, III

[57] ABSTRACT

A perimeter lighting system using monosymmetrical quasi-indirect light fixtures recessed in the ceiling of a room, near the walls, to direct light toward the walls and thereby cause it to be reflected from them at optimum elevation for maximum overall lighting of the typical working area in the room, thereby producing a high contrast rendition factor over much of the work task zone.

14 Claims, 12 Drawing Figures

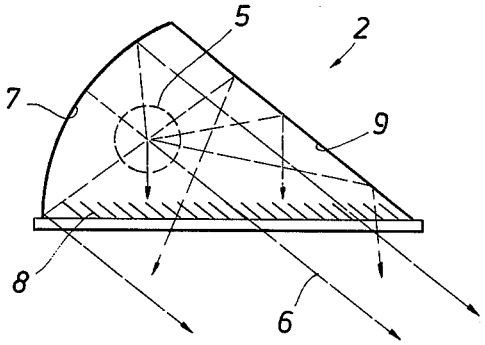
FIG. 9
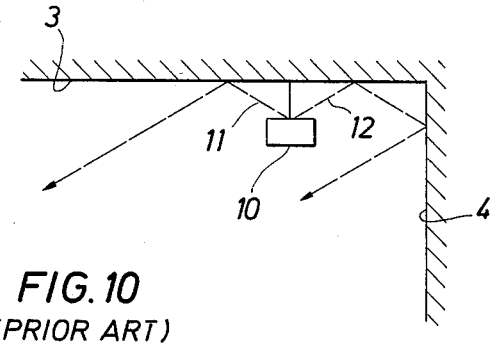
FIG. 10
(PRIOR ART)
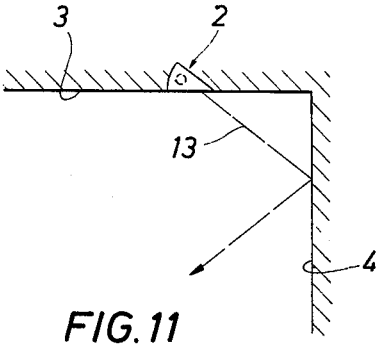
FIG. 11
FIG. 12
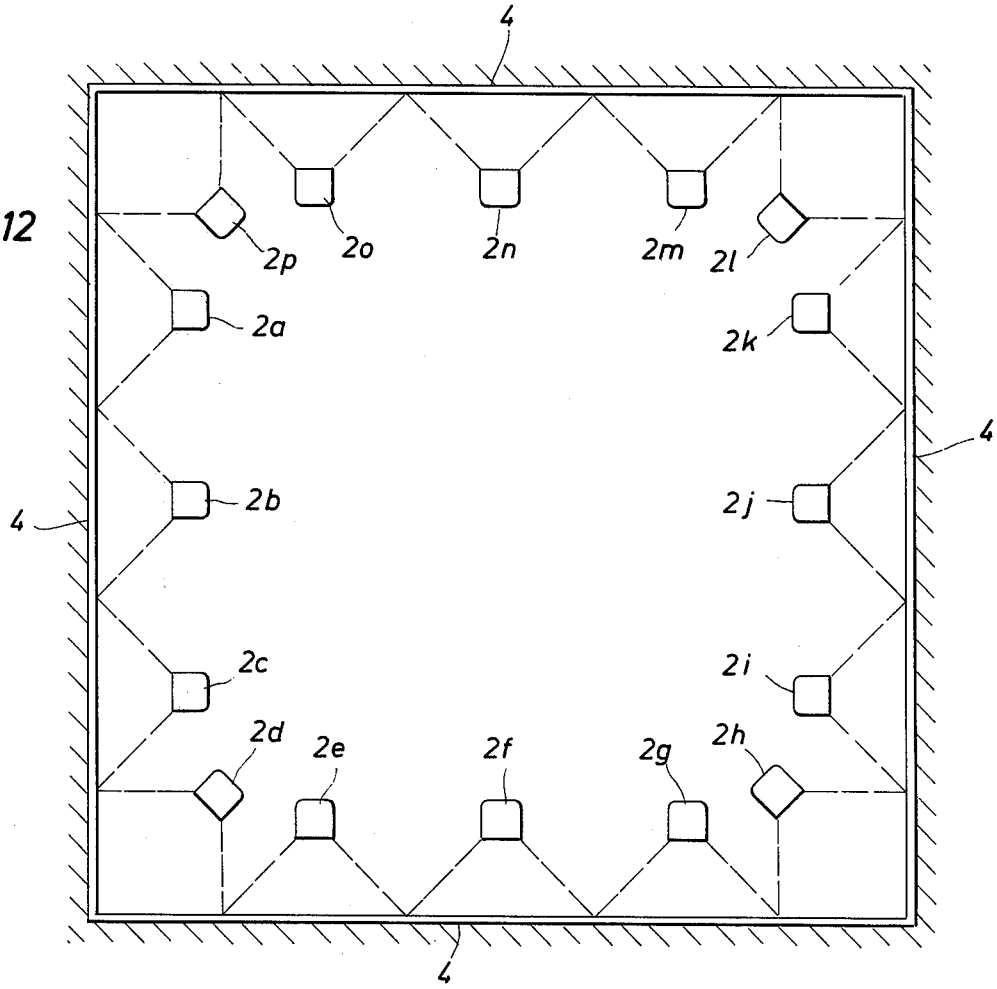

QUASI-INDIRECT MONOSYMMETRICAL LIGHTING SYSTEM

RELATED APPLICATION

This application is a continuation-in-part of a copending patent application by the same inventor, Ser. No. 376,320, filed July 5, 1973 now abandoned.

BACKGROUND OF THE INVENTION

This invention relates to lighting systems generally, and more specifically, to an improved perimeter lighting system for producing more effective room lighting. A perimeter lighting system involves light fixtures located near the room walls, and may be employed primarily for wall lighting or for general room illumination, by reflection of the light from the walls. The importance of the invention is seen when the need for accurately determining where and how much lighting is necessary for effective illumination at a minimum of overall lighting expense is considered.

Maximizing lighting effectiveness is thus important because of the desirability of minimizing the amount of lighting used, that is, raw lumens, and hence, minimizing lighting expense, initially as well as in the long run. For example, a system which is twice as effective as an otherwise comparable system may require only half as many footcandles to provide the same amount of effective light, that is, to enable persons in the room to see and perform the same tasks as effectively. The benefits are (1) cutting the power requirements for the lighting system up to one-half, (2) eliminating some of the heat that must otherwise be removed from the room, (3) rendering easier the control of the luminance in the room, since the fixtures need produce less light, and (4) attaining better visual comfort. Further, utilization of more effective lighting systems results in benefits to society as a whole, including reductions in power requirements, thermal pollution, and brown-out and black-out hazards, as well as a lower consumption of natural resources.

In order to evaluate the effectiveness of various lighting systems, comparative standards are needed. The *Illuminating Engineering society* (IES) has established a system that compares the performance of any lighting system to the *Equivalent Sphere Illuminaton* (ESI) that would be attained if the task were illuminated by a perfectly and uniformly luminous system, such as would be attained inside a photometric sphere. IES standards are generally based on ESI levels. The ESI system applies specifically to the "standard school task" of reading pencil handwritting on tablet paper, but more generally to tasks with similar characteristics, such as typing and drafting, and reading printed matter and duplicated material. Lighting systems which give superior performance for the standard school task will also perform well for these other tasks.

ESI is actually the effective lighting level of a system; it is the end product in terms of performance of a given lighting system. That is, it is the amount of light from a perfectly uniform systems that gives the same visual performance as the system being designed. For example, if a system is producing a "raw footcandle" level of 200, with an ESI of 84, this means that 84 footcandles from a perfectly uniform system would provide the same visual effectiveness as is provided from the 200 footcandles of the system being studied. The effectiveness of the system (42% in this example) is the *Lighting Effectiveness Factor* (LEF). This factor is most important in determining which lighting system is best, but is dependent on a more basic factor — the *Contrast Rendition Factor* (CRF). The CRF is not dependent upon the raw footcandle illumination level, and thus gives a direct means for comparing the relative effective values of different lighting systems. The CRF is dependent only upon the quality of the lighting systems, that is, on the geometry and room conditions, and thus is an expression of the relationship between the contrast of the standard school task under a given test lighting system and of the standard school task under the perfectly uniform system (ESI). Certain lighting systems will achieve CRFs in excess of 1.0.

Computation of CRF is very difficult, to the point of requiring a computer for accurate, practical determinations. However, it is not really necessary to compute CRF to select designs with high visual performance, as a knowledge of how CRF behaves with different geometries and types of lighting equipment is sufficient for selection of the most promising combinations, which can then be evaluated. The lighting system geometry has by far the greatest effect of all the factors on the visual performance of a lighting system.

The different geometries which must be considered are the different degrees of symmetrical luminaires, that is, the symmetrical variations of the output of the various complete light units. There are basically three degrees of symmetry relevant to luminaires: axially symmetrical, bisymmetrical, and monosymmetrical, illustrated in FIGS. 1, 2, and 3, respectively.

A luminaire which has the same candlepower distribution in every vertical plane through the center of axis of the luminaire is said to be axially symmetrical. That is, every vertical plane through the center of an axially symmetrical luminaire will have an identical candlepower distribution pattern, as shown in FIG. 1. Although the term asymmetrical is sometimes used to denote any degree of symmetry that is not absolute, that is, not axially symmetrical, the more precise designations of these degrees are bisymmetry and monosymmetry. General asymmetry is a complete lack of any symmetrical pattern.

However, any vertical plane through the axis of a bisymmetrical luminaire has the same candlepower distribution on each side of the axis, but each vertical plane (through the axis, but at different rotational angles) has a different distribution curve. That is, the distribution pattern is symmetrical through each and every vertical plane, but the candlepower distributions vary depending upon the angular attitude of the vertical plane, as shown in FIG. 2.

Likewise, a monosymmetrical luminaire has identical candlepower distribution patterns on either side of the horizontal axis through the direction of primary light distribution. That is, the light pattern is symmetrical on (1) the one vertical plane through the vertical axis at a perpendicular angle to the effective direction of primary light distribution, and (2) infinite vertical planes at various distances from the vertical axis, and perpendicular to the horizontal axis in the direction of primary light distribution, as shown in FIG. 3.

The primary light distribution patterns for both the axially symmetrical and bisymmetrical luminaires are ordinarily directed vertically downward, as shown by the fixture 1 in FIG. 4. The primary light distribution pattern for the monosymmetrical luminaire is generally directed outwardly from the center, in the same direction as the axis about which the distribution pattern (as seen in the imaginary vertical planes referred to above) is symmetrical, as shown by the fixture 2 in FIG. 4. The symmetrical pattern of the light distribution of fixture 2 in FIG. 4 would be seen on the vertical plane extending perpendicularly through the FIG. 4 page, intersecting the axis of symmetry of the light distribution pattern.

When either axially symmetrical or bisymmetrical luminaires are utilized, more light is directed downward, directly toward the work task area, than toward the wall for reflection toward the work task area at a shallow angle (to the horizontal). In contrast, a monosymmetrical luminaire aimed at the wall results in substantially more light being reflected off the wall toward the work task area. The wall-reflected illumination is more effective in producing the ESI than is the light from overhead. Hence, the monosymmetrical light distribution pattern, if properly directed, will result in the greatest ESI and CRF values.

Previous lighting systems have generally employed axially symmetrical reflecting fixtures. The effectiveness of their application in areas where wall reflection would otherwise provide substantial improvements in room lighting is limited by their axially symmetrical light distribution patterns. Various arrangements have been attempted with axially symmetrical fixtures in an effort to achieve CRFs in excess of 1.0. Although CRF is a ratio of a given system under study to a perfectly uniform system, it is not altogether uncommon to produce a CRF value greater than 1.0, since certain arrangements involving light reflective walls can result in greater LEFs than would the uniform system. For example, a room lighted by a direct-indirect lighting system with typical walls that result in fairly diffuse reflection, as shown in FIG. 10, may result in CRFs in excess of 1.0 over most of the room.

Direct-indirect lights typically provide 40–60% of their output downward, and 40–60% upward to be reflected off the ceiling toward the working area of the room, and for peripheral fixtures, toward the wall and then toward the works tasks. Suspended direct-indirect luminaires thus provide substantially equivalent amounts of their output upwardly and downwardly, with very little light emitted at angles near the horizontal. No light is shown in FIG. 10 as being directed downwardly because the comparative interest in that illustration is in the light reflected off the ceiling and wall.

Suspended semi-indirect luminaires are depending fixtures aimed back toward the ceiling, with 60–90% of their output directed upward for reflection off the ceiling and walls, and 10–40% directed toward to produce a luminaire luminance that closely matches that of the ceiling. These fixtures will generally exceed the performance of direct-indirect lighting systems, since less light is reflected or irradiated from directly overhead, as more light is reflected off the walls, at least for the perimeter area fixtures. Pure indirect lighting results in 90–100% of the output being directed toward the ceiling and upper side walls, and 0–10% being directed downward.

A system that eliminates the loss in the reflection off the ceiling can result in even greater CRF values, for the light from the ceiling to the task is less effective than light reflected directly off the wall. To achieve the highest CRF values under most conditions, the light must illuminate the work task area in a near horizontal direction, that is, from a reflecting surface at an elevation only slightly above the work task plane. This requirement that the light source (reflective wall) be slightly above the work plane effectively precludes use of ceiling mounted direct lighting, which results in 90–100% of the light output being directed downward, the concentration depending on the reflector material, finish, and shape. Luminous ceilings involve direct lighting, but are poor for providing adequate illumination from the near-horizontal zone (with respect to the work task area). That is, the CRF (at the location of the work task) produced by the ideally effective ESI level may be exceeded still further (with no additional light source) by an arrangement involving quasi-indirect lighting and light-reflective walls. Quasi-indirect lighting thus eliminates the reflection off the ceiling since the fixtures are recessed in the ceiling, and are aimed directly at the walls, at such an angle that the maximum amount of diffuse light is attainable from reflections off the wall at an elevational range (on the vertical wall) that provides the greatest CRF values in the work task zone. The prior art includes recessed symmetrical fixtures, but their distribution patterns do not provide as much light to the reflective walls as do equivalent monosymmetrical fixtures.

The LEF of the lighting used for any particular task is determined only partly by the amount of light which is present. More important than the amount of light is the adaptation of the light to the particular task being performed. If reflection from a particular task renders it difficult to see well, and if it is feasilbe to move the task with respect to the light, then the solution for increasing the LEF is obvious: move the work task or the light source. However, if the light source is immovable, or if it is necessary for the viewer to see in several different directions, it may well be unfeasible to move the work task and/or light source. In such a case, more effective lighting is necessary.

In order to provide effective lighting for work tasks in a given area, the light must come from directions other than directly above the work task. The most desirable location of illuminating sources is near the horizontal work place, that is, above the working area, at an angle in a range from 0° to 30° to the work place. In order to provide such illumination by means of ceiling mounted fixtures, the light must be reflected off the walls as well as come directly from the fixtures (in the more central areas of the room). Moreover, the elevation on the wall from which the main light distribution is reflected is of paramount importance in achieving a high ESI value.

Because it is desirable for the illumination to bounce off the wall rather than the ceiling, spot-type lights may be used more effectively if they are aimed directly at the wall (at the optimal angle) rather than indirectly via the ceiling. Directed spots have been used in room settings for decoratively featuring pictures or other artifacts on walls, but it has generally been thought unfeasible to use direct lighting as a useful method of generally illuminating a room for typical work tasks. Even the so called wall washes, by which an entire wall panel is lighted, produce relatively little useful light for general lighting purposes, that is, for typical work tasks. The problem is usually that the light fixtures are positioned so close to the wall that the light from the fixtures strikes the wall at a relatively low angle (with respect to the vertical wall). Such close positioning effectively washes a substantial portion of the wall with light, and without reflecting excessive light back into the work task area of the room. In fact, the stated purpose of such arrangements is frequently to minimize general room illumination, to prevent such light from detracting from the artistic high-lighting purpose for which the wall is illuminated.

Perimeter lighting with one or more direct-indirect light fixtures dropped from the ceiling such that 40–60% of the light will radiate back toward the ceiling and be reflected off it to the wall, and in turn be reflected from the wall into the work task area of the room, generally provides more effective lighting for work tasks than direct lighting. A schematic of direct-indirect perimeter lighting fixture is shown in FIG. 10. Various indirect lighting systems have long been used in buildings with high ceilings, as ample height is a prerequisite to such a system. The lower ceilings of today's architectural designs often make it impractical and/or old fashioned to have drop lights for perimeter lighting systems. However, luminous ceilings (a form of direct lighting) are often prohibitively expensive, generally difficult to maintain, and often impractical because of construction code requirements concerning the use of large areas of combustible plastics. In such cases, the only way to obtain high and uniform performance is by one form or another of indirect lighting. Quasi-indirect monosymmetrical perimeter lighting, that is, lights recessed in the ceiling along the periphery of the room, and directed downward toward the wall at a relatively high angle with respect to the wall, as shown in FIG. 11, so that the main light distribution pattern wili be directed toward that area of the wall from which reflected light will produce the greatest CRF in the work task zone, can provide still further enhanced lighting effectiveness.

It is very desirable to have a low entry angle from the wall, that is, reentry of the light from the wall at a low angle to the horizontal work plane. Utilization of perimeter lighting with this low reentry angle allows attainment of the required ESI with fewer raw footcandles than with inferior lighting systems producing a lower CRF.

It is therefore a feature of the present invention to provide an improved perimeter lighting system using monosymmetrical light fixtures that may be mounted substantially flush with the ceiling, that is, recessed in the ceiling, with the lighting objective of illuminating the room, not merely the walls.

It is another feature of the present invention to provide an improved perimeter lighting system using monosymmetrical light fixtures to obtain a higher CRF than is achievable by means of a substantially identical peripheral lighting arrangement of axially symmetrical or bisymmetrical light fixtures.

It is still another feature of the present invention to provide an improved perimeter lighting system using monosymmetrical light fixtures for achieving optimum reflection from the walls of a room, for illuminating typical work tasks and for minimizing the effects of direct illumination which tends to cause veiling glare.

SUMMARY OF THE INVENTION

A preferred embodiment of the subject invention comprises the optimum placement of, and the utilization of novel monosymmetrical lighting fixtures, in combination with a room ceiling and one or more adjacent diffuse light-reflecting walls. The monosymmetrical fixtures are recessed in the ceiling, fairly close to the periphery of the room, so that the main light distribution patterns of the fixtures, aimed toward the walls, will be reflected off the walls at the optimum elevation for producing a high contrast rendition factor. The main light distribution pattern of the fixtures is in the range of 30–70° to the horizontal ceiling. The reflected light from the wall produces a higher contrast rendition factor in the area in which work tasks are typically performed in the room than that produced by a substantially identical peripheral arrangement of axially symmetrical lighting fixtures of the same candlepower.

BRIEF DESCRIPTION OF THE DRAWINGS

In order to better understand the above-recited features, advantages, and objects of the invention, as well as others which will become apparent, reference is made to the drawings of the embodiments and of results of tests which confirm the explanations of the importance of directing the light pattern toward the reflecting wall in a particular angular range.

FIG. 5 is for the ceiling.

FIG. 6 is for the side wall.

FIG. 7 is for the rear wall.

FIG. 8 is for the front wall.

FIG. 9 is a schematic of a typical monosymmetrical lighting fixture employed in the preferred embodiment of the subject invention.

FIG. 10 is an illustration of the prior art system of indirect lighting using an axially symmetrical lighting fixture in an indirect-perimeter configuration.

FIG. 11 is an illustration of a monosymmetrical lighting fixture used in a quasi-indirect, perimeter configuration in accordance with the subject invention.

FIG. 12 is a plan view of a typical room illuminated with monosymmetrical lighting fixtures in a quasi-indirect, perimeter configuration in accordance with the subject invention.

DESCRIPTION OF PREFERRED EMBODIMENT

Figure 1:
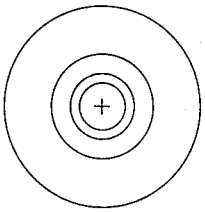
FIG. 1 is a schematic of axial symmetry, that is, of an axially symmetrical lighting pattern.

The preferred embodiment of the instant invention constitutes the determination of the optimum peripheral placement of novel recessed quasi-indirect monosymmetrical lighting fixtures, for achieiving the highest CRF and ESI values over the greater portion of normal work task areas in the room, but without the lighting losses inherent in direct-indirect and semi-indirect systems.

In order to evaluate the effectiveness of light reflected from ceiling and wall surfaces, the illumination of the various surfaces must be considered. The critical question is: where should the wall be illuminated so as to provide the maximum possible ESI and CRF values?- The general answer is that the illuminated wall surface should extend from the level of the work plane up to a level at which the relative ESI potential approaches 100. The IES sidewall brightness chart provides this height: one-half the distance from the wall to the work task zone. A relatively diffuse reflecting surface, such as a typical wall, will then serve to best illuminate the work task zone by reflecting the incident light from the ceiling mounted fixtures.

With this determination at hand, two questions remain: (1) how far from the wall should the recessed quasi-indirect fixture be located, and (2) what parameters define the necessary distribution of the monosymmetrical pattern?The solutions are interdependent since the main light distribution pattern must be big enough to efficiently contain light energy, while the reflector must be at the optimum distance for illumination of the effective area, but not so far as to necessitate wasting lumens. The distance between the wall and the light fixture is governed by the determination of the requisite angle of incidence to the wall, and by the light distribution pattern of the reflector.

In most situations, the lighting fixtures should be located a distance from the wall defined by 30–50% of the distance from the work plane to the ceiling. When the fixture placement is in this range, the angular definition of the edges of the main light distribution pattern should generally be in the range 30°–70° to the ceiling, or 20°–60° to the normal to the ceiling at the point where the fixture is located. At the typically closest fixture location (30% of distance from work plane to ceiling), the angular range of the main light distribution pattern of the fixture should be about 40°–70° to the ceiling, or 20°–50° to the normal. Likewise, for the typically furthest fixture location (50% of distance from work plane to ceiling), the angular range of the main light distribution pattern should be about 30°–60° to the ceiling, or 30°–60° to the normal. Additional variables in the exact location in a particular instance include the horizontal and elevational extremes of the location of the work tasks.

FIGS. 5–8 illustrate the results of tests of lighting effectiveness of diffuse light sources in various areas on the ceiling, side, rear, and front wall surfaces, respectively. The work task is located at the point indicated on the grids at 0.00. The numbers on the grids represent distances that are multiples of the distance from the wall surface to the work task zone, such that the distance from 0.00 to 2.00 is twice the distance between the wall surface and the work task. The numbers on the various curves represent the ESI values that are produced at the work task when the source is located on the various curves. For example, when the light source is located anywhere on the curve numbered 80, the ESI at the work task area (0.00 on the drawing grids) is approximately 80 footcandles. The variables in the determination of the ESI levels, for example the distance from the source, were selected so as to give ESI values around 100, so that the curves could be thought of in terms of percent effectiveness. The cross-hatched areas in the drawings represent the body shadow, and thus cannot be ignored since they block some of the more effective zones. The rear wall is the surface most affected.

Figure 6:
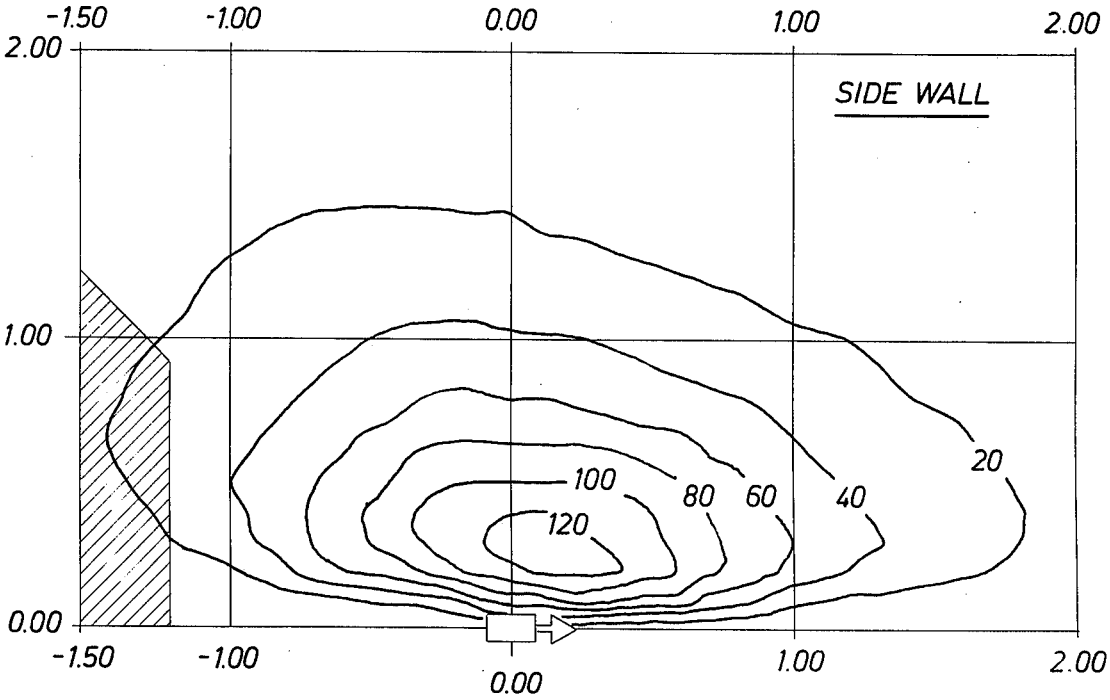
FIGS. 5–8 are surface diagrams showing the ESI at the location of the work task in the room, for various source locations of diffused lighting surfaces.
Figure 5:
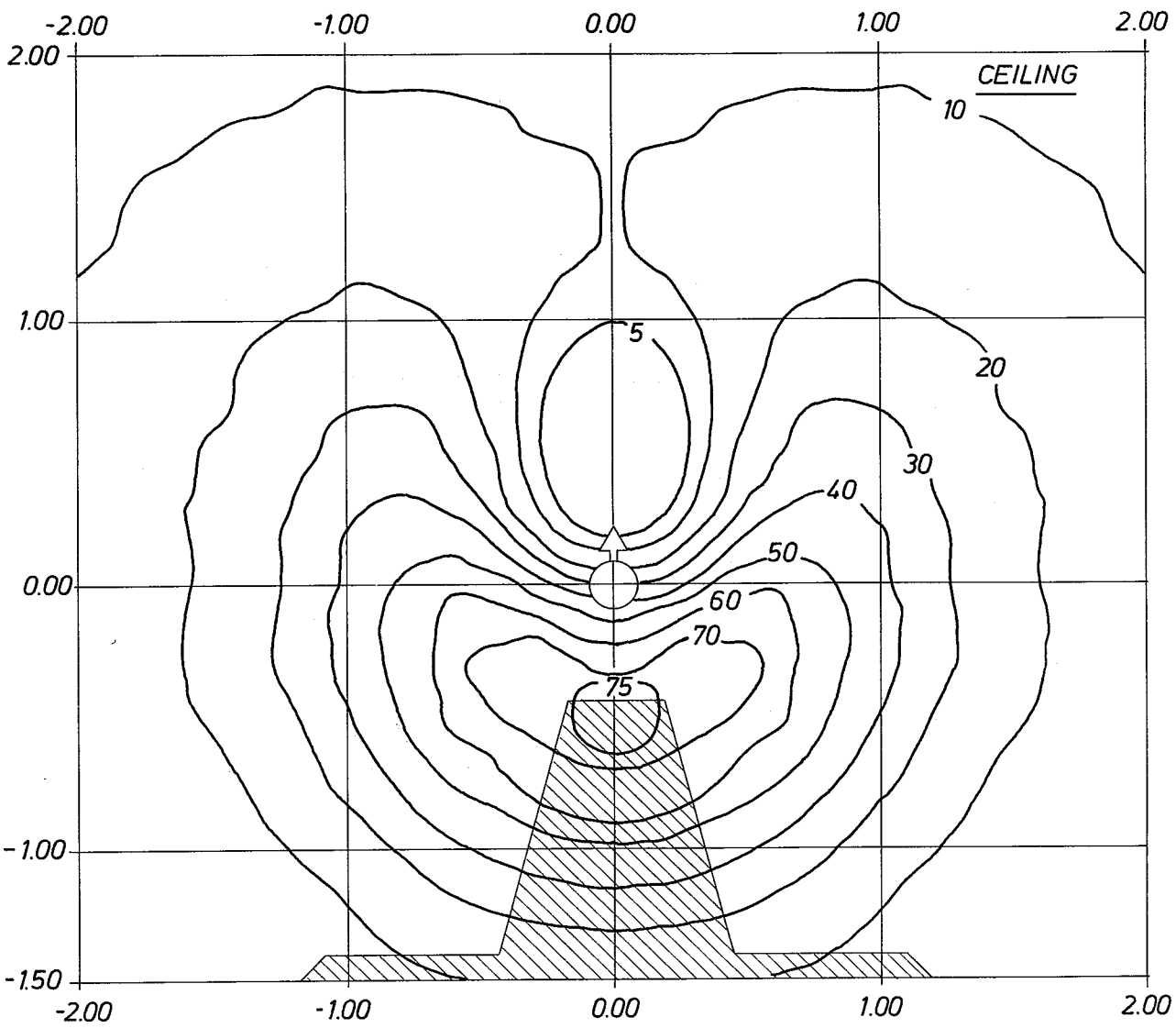
Figure 7:
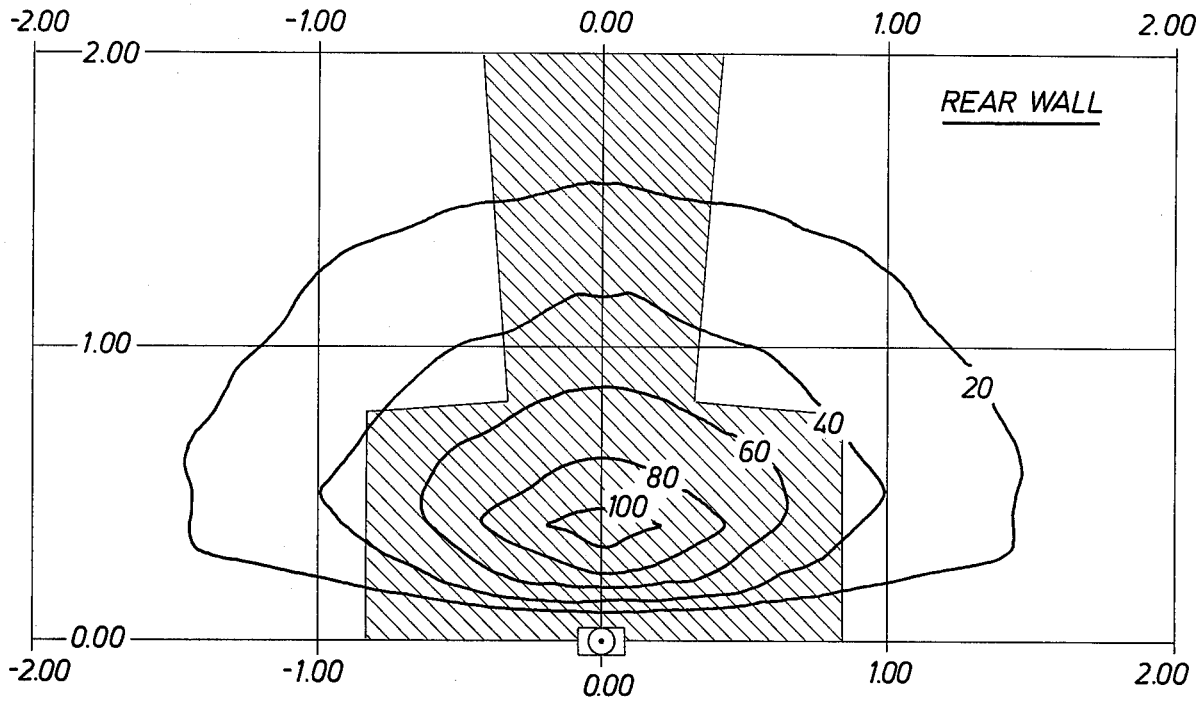
Figure 8:
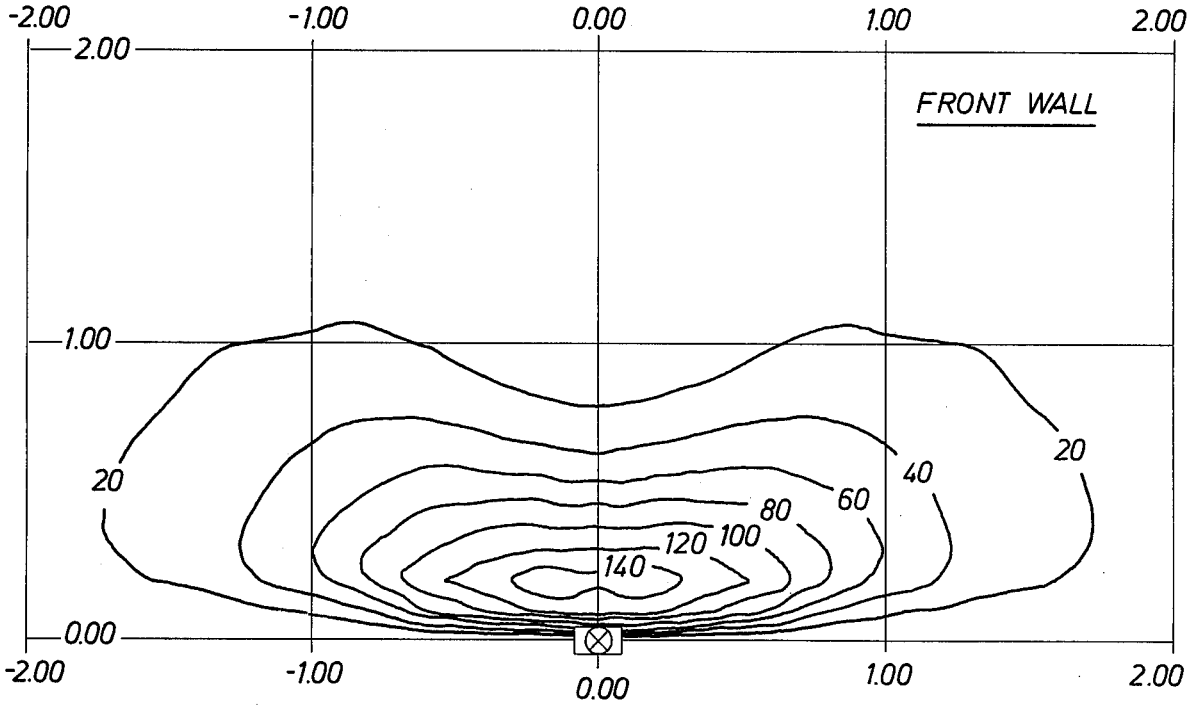

Note that most areas of the walls in FIGS. 6–8, exhibit higher ESI values than those shown in the ceiling drawing, FIG. 5. This substantiates the above explanation of the wall being a more effective illumination source than the ceiling. If a ceiling-mounted fixture were available for an indirect-type lighting scheme, it would thus be most effective to reflect it off a wall, as opposed to a ceiling. More precisely, FIGS. 6–8 indicate that the ESI values at the location of the working area, indicated in the drawings on the grids at 0.00, vary between 80 and 120 footcandles in the angular range of about 10–25°, that is, when light is reflected from the walls in the range between 10° and 25° with respect to the work task zone, the angle being measured from the horizontal. These values are substantially higher than those resulting from direct ceiling illumination, indicated by FIG. 5, and also than those resulting from reflections from the walls above the 25° level, where the ESI levels diminish significantly, as shown in FIGS. 6–8. These tests mandate the conclusion that the locus of illuminated wall surface is critical, and that this locus is most desirably the zone defined by the angular range 10°–25° with respect to the horizontal, or 65°–80° to the vertical, measured from the upper and lower extremes of the illuminated surface on the wall. These figures vary depending on the distances from (1) ceiling to work plane, (2) wall to work task, and (3) wall to lighting fixture. The angular definition of the desirably illuminated zone, measured with the work task zone as the reference, is convenient for purposes of expression, but the more usable definition of the illuminated wall surface is in terms of the actual measurements. These are dependent on the distance from the wall to the work task. FIGS. 6–8 confirm that the elevation of the illuminated wall zone, measured from the work plane, should be up to 60% of the distance from the work task to the wall, since (1) the grid units are multiples of these distances, and (2) the ESI zone from 80 footcandles and up on all three wall surface drawings measures from points on the wall surface equivalent to about 20 up to 60% of the distance from the task to the wall.

The tests thus substantiate that the highest ESI levels are attained when the lighting emanates from an area relatively close, in terms of elevation, to the level of the work task. More precisely, employment of the identical light source at the same distance from the work task in the cases of (1) ceiling illumination and (2) wall illumination results in 50 to 100% greater ESI levels in the latter cases. Considering only the wall placement of the main light distribution pattern, as a step in determining the optimum location of the light source itself, FIGS. 6–8 confirm that the greater ESI levels result from reflection locations on the wall surfaces at elevations a relatively small distance above the reference height of the work task. The optimum angular range of the illumination from the recessed overhead monosymmetrical fixture to the reflecting wall surface is thus optimally in the range between approximately 2°–60° measured with respect to the vertical, or 30°–70° from the horizontal ceiling from which the light emanates. This angular range is critical in achieving the ideal CRF values for good illumination at minimum expense in terms of raw candlepower requirements.

Figure 2:
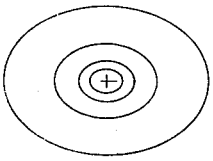
FIG. 2 is a schematic of bisymmetrical symmetry, that is, of a bisymmetrical lighting pattern.
Figure 3:
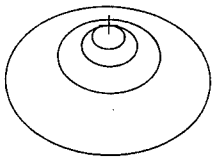
FIG. 3 is a schematic of monosymmetry, that is, of a monosymmetrical lighting pattern.
Figure 4:
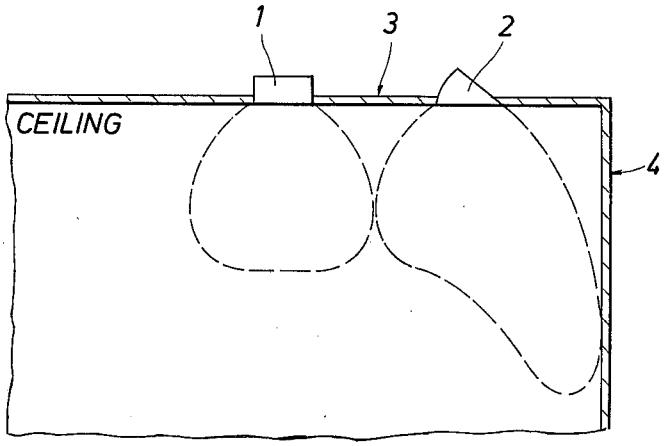
FIG. 4 is an illustration of two lighting fixtures: the first exhibits an axially symmetrical light distribution pattern, while the second exhibits a monosymmetrical light distribution pattern.

In reference to the other drawings, FIG. 4 illustrates a contrast between the light distribution patterns of a monosymmetrical fixture 2 and an axially symmetrical fixture 1. The light distribution pattern shown for fixture 1 in FIG. 4 could also be a bisymmetrical distribution pattern, such as that shown in FIG. 2.

FIG. 9 illustrates a schematic of a monosymmetrical lighting fixture 2. Unlike a conventional lighting fixture having a single source of light which irradiates the light from the fixture in an even distribution pattern, a monosymmetrical lighting reflector generally directs the light from its source 5 in a primary direction 6 in both the cases of light directly from the bulb 5, and light reflected from the arcuate reflector 7. A diffusion effect results from light reflected off the planar reflector 9, and off the combination of the planar reflector 9 and the arcuate reflector 7. Louvers 8 are positioned at an angle across the opening of the lighting fixture 2 so as to direct most of the lighting pattern in the general direction 6. However, some of the light from source 5 and from the reflecting surfaces 7 and 9 tends to be blocked by the louvers 8, and exits from the fixture in directions such that a somewhat diffused effect results. The arcuate reflector 7 is curved so as to maximize the amount of light shining in direction 6. Elimination of the louvers 8 results in a substantially more diffused effect, with perhaps 60–80% of the light output being in the main light distribution pattern, and from 20–40% being diffused in other directions. The angle and length of the louvers 8 control the diffuse light emissions. Monosymmetrical light fixtures similar to that in the embodiment of fixture 2 could utilize multiple light sources, as opposed to the single source 5 in FIG. 9. The fixture 2 could also utilize a prismatic lens.

FIG. 10 illustrates the prior art system of direct-indirect perimeter lighting using a single fixture 10. The fixture 10 is a drop light, hung from the ceiling 3 such that light emanates from the fixture in directions both upward toward the ceiling (40–60% of the light), and downward (40–60% of the light), directly toward the working areas in the room. The light emanating upwardly is reflected from the ceiling 3 back toward the area of the work tasks and also from the ceiling 3 to the wall 4, and in turn back into the area of work tasks. Because the comparison of ceiling reflection is of interest here, the direct light irradiation downward into the room is not shown. The light following path 12, after it is reflected from the ceiling 3 and in turn from the wall 4, approaches the area of work tasks in the room from a much lower elevation than the light reflected directly off the ceiling 3, or the light emanating directly downward from the light fixture 10. The lower level from which light reflected from the wall 4 the working zone illuminates is advantageous because a greater CRF results in the work task zone, i.e., the area to which the light is intended to be directed.

However, the prior art system has the disadvantage of lighting loss in the reflection from the ceiling 3 before the light is reflected toward the wall 4, and then reflected back toward the working area. Furthermore, in contemporary office architecture, the prior art system of indirect lighting has the additional shortcoming of extending too low into the room. Because it is necessary, in order to derive the real benefit from an indirect lighting system, to have the fixtures depend substantially lower than the ceiling level, such lighting systems have been used much less in recent times. The amount of light absorbed in the ceiling surface due to the first reflection, before the light is reflected toward the wall, has also contributed to designers' reluctance to use indirect lighting systems, since stronger lights are required to obtain the necessary amount of illumination. And, light reflected from ceilings does not produce a CRF as great as that produced by light reflected from walls.

An ideal lighting system eliminates the problems of (1) unnecessary losses in reflections from overhead surfaces, (2) drop lights depending into the room area, thus requiring a higher ceiling, (3) substantial amounts of light emanating directly downward toward the area of the work task, thus resulting in much more light being required to achieve a high CRF, and (4) high lumen levels required to provide the desired CRF and LEF values.

FIG. 11 illustrates the placement of the monosymmetrical lighting fixture in a flushly mounted fashion, such that the entire fixture is recessed in the ceiling 3, not extending into the room, and is mounted near the perimeter of the room, such that the light will reflect downward toward the wall 4 and back toward the work task area in the room.

The preferred embodiment of the subject invention, as shown in FIG. 11, has various advantages over previous fixtures. The recessed monosymmetrical lighting fixtures, which are aimed at the wall at the optimum angle for reflecting the primary light distribution pattern back toward the area of the work tasks with resultant high CRF values, thus advantageously illuminate the work task zone from the desirable reflecting zone on the walls. And, the added advantages are that (1) the light losses in the reflection to the ceiling are eliminated, and (2) illumination directly downward toward the work task is drastically decreased. Further, since the unit is entirely recessed in the ceiling, that is, flush mounted, there is no need for a high ceiling which would ordinarily be required in the case of direct-indirect or semi-indirect lights depending from that ceiling. Thus, greater CRF and LEF values are attainable at a minimal overall lighting expense.

The subject invention thus contains the advantages of indirect lighting, without the disadvantages of symmetrical distribution patterns. It is thus a quasi-indirect monosymmetrical perimeter lighting system, and produces a CRF in excess of a similar peripheral lighting arrangement involving axially symmetrical fixtures.

FIG. 12 illustrates a room layout of monosymmetrical fixtures 2*a*–2*p* in a perimeter arrangement. The lighting patterns shown are to emphasize the primary direction of light distribution. In a room as large as that shown in FIG. 12, it would likely be desirable to have axially symmetrical fixtures in the interior areas of the room, to aid in illumination of the work tasks areas away from the perimeter of the room. However, those conventional fixtures have not been shown in FIG. 12. On the other hand, in a somewhat smaller room, the illumination is ordinarily quite satisfactory by means of perimeter arrangements of monosymmetrical fixtures alone. As indicated previously, the illumination is superior to that from conventional overhead fixtures.

While particular embodiments of the invention have been shown and described, it is to be understood that the invention is not limited to those embodiments, since many modifications may be made and will become apparent to those skilled in the art. For instance, the louvers shown in the monosymmetrical fixture 2 in FIG. 9 may be decreased in size or number, or eliminated altogether, if it is desired to have an enhanced and more diffused lighting effect with slightly more light downward. Even in such a case, the primary light distribution pattern would still be in the direction toward the wall at which the fixture 2 is aimed.

What is claimed is:

1. In combination with a room ceiling and an adjoining vertical light-reflective wall, a peripheral lighting arrangement, comprising at least one flush-mounted light fixture for producing monosymmetrical light distribution recessed in said ceiling, spaced in close proximity apart from said wall; said spacing beng .3 to .5 of the distance from said ceiling to the elevation below at which the optimum illumination is desired, said elevation below said ceiling at which the optimum illumination is desired being located in the lower vertical one-half of the room, and having a main light distribution pattern directed downward from said fixture toward said wall, said light distribution pattern being at an angle between 30° and 70° to said ceiling, the impinging and reflected light to and from said wall producing an average contrast rendition factor in the work task area of the room in excess of that produced by a substantially identical peripheral lighting arrangement involving one or more light fixtures producing axially symmetrical light distribution.

2. In combination with a room ceiling and first and second adjoining light-reflective walls tending to a corner, a peripheral lighting arrangement, comprising:

at least one first flush-mounted light fixture for producing monosymmetrical light distribution recessed in said ceiling, spaced in close proximity apart from said first wall, said spacing being 0.3 to 0.5 of the distance from said ceiling to the elevation below at which the optimum illumination is desired, said elevation below said ceiling at which the optimum illumination is desired being located in the lower vertical one-half of the room, and having a main light distribution pattern directed downward from said fixture toward said first wall, said light distribution pattern being at an angle between 30° and 70° to said ceiling; at least one second flush-mounted light fixture for producing monosymmetrical light distribution recessed in said ceiling, spaced in close proximity apart from said second wall, said spacing being 0.3 to 0.5 of the distance from said ceiling to the elevation below at which the optimum illumination is desired, and having a main light distribution pattern directed downward from said fixture toward said second wall; said light distribution pattern being at an angle between 30° and 70° to said ceiling; and a third flush-mounted light fixture for producing monosymmetrical light distribution recessed in said ceiling, spaced in close proximity apart from said corner formed by said first and second walls, said spacing being 0.3 to 0.5 of the distance from said ceiling to the elevation below at which the optimum illumination is desired, and having a main light distribution pattern directed downward from said fixture toward said corner, said light distribution pattern being at an angle between 30° and 70° to said ceiling, the impinging and reflected light to and from said first and second walls producing an average contrast rendition factor in the work task area of the room in excess of that produced by a substantially identical peripheral lighting arrangment of light fixtures producing axially symmetrical light distribution.

3. The method of quasi-indirectly illuminating a room having a ceiling and an adjacent and abutting vertical light-reflective wall, which comprises directing a plurality of flush-mounted light fixtures for producing monosymmetrical light distribution recessed in said ceiling near the junction of said ceiling and said wall, spaced from 0.3 to 0.5 of the distance from said ceiling to the elevation below at which the optimum illumination is desired, said elevation below said ceiling at which the optimum illumination is desired being located in the lower vertical one-half of the room, so that their main light distribution patterns are directed downward from said fixtures toward said wall, said light distribution pattern being at an angle between 30° and 70° to said ceiling, the impinging and reflected light to and from said wall producing an average contrast rendition factor in excess of that produced by a substantially identical lighting arrangement of light fixtures producing axially symmetrical light distribution.

4. In combination with a room ceiling and an adjoining vertical light reflective wall, a light system for quasi-indirectly illuminating such room, comprising one or more flush-mounted light fixtures for producing monosymmetrical light distribution recessed in said ceiling, each of said light fixtures comprising:

an arcuate reflector segment;

a substantially flat planar reflector segment, the upper edge of which is adjacent the upper edge of said arcuate reflector segment;

connector means for actuating one or more light sources;

means for enhancing a main light distribution pattern from said fixture; a prismatic lens; and a housing supporting said reflector segments, said pattern enhancing means, said connector means, and said prismatic lens.

5. The light system described in claim 4, wherein said pattern enhancing means includes a plurality of substantially parallel louvers disposed between said reflectors.

6. The light system described in claim 5, wherein said louvers are translucent plastic.

7. The light system described in claim 5, wherein said louvers are opaque metal.

8. The light system of claim 5, wherein said louvers are supported at such an angle, and are of sufficient length, that light is prevented from passing directly downward toward the work task area in the room.

9. The light system described in claim 5, wherein said louvers are supported at an angle between 40° and 60° to the ceiling surface.

10. The light system described in claim 4, wherein said arcuate planar reflector is supported such that the axis of said reflector is at an angle between 40° and 60° to said ceiling.

11. The light system described in claim 4, wherein said prismatic lens, in combination with said reflectors, results in a main light distribution pattern directed at an anlge between 40° and 60° to said ceiling.

12. The light system described in claim 4, wherein said substantially flat planar reflector is supported at an angle between 40° and 60° to the ceiling surface.

13. The light system described in claim 4, wherein said housing also supports side reflector pieces.

14. The light system described in claim 4, wherein said reflectors are coated with mirror like surfaces.

* * * * *